United States Patent [19]

Perring

[11] Patent Number: 4,482,843

[45] Date of Patent: Nov. 13, 1984

[54] GYROTRON DEVICE

[75] Inventor: Dudley Perring, Charvil, England

[73] Assignee: Thorn EMI-Varian Limited, Hayes, England

[21] Appl. No.: 346,201

[22] Filed: Feb. 5, 1982

[30] Foreign Application Priority Data

Feb. 10, 1981 [GB] United Kingdom ..... 8104066

[51] Int. Cl.[3] ..... H01J 25/00

[52] U.S. Cl. ..... 315/4; 372/2; 315/3; 315/5; 315/5.24

[58] Field of Search ..... 315/3, 4, 5, 5.24, 5.26, 315/5.27, 5.28; 372/2

[56] References Cited

U.S. PATENT DOCUMENTS 4,199,709 4/1980 Alirot et al. ..... 315/5

4,224,576 9/1980 Granatstein et al. ..... 315/5

4,393,332 7/1983 Symons ..... 315/4

*Primary Examiner*—Saxfield Chatmon

*Attorney, Agent, or Firm*—Fleit, Jacobson, Cohn & Price

[57] ABSTRACT

A gyrotron device e.g. a gyrotron oscillator (FIG. 3) or a gyrotron amplifier (FIG. 4) in which a circular waveguide is dimensioned to operate in a transverse electric mode ($TE_{01}$) as an interaction region at an RF frequency $\omega_o$. An injection means directs a beam of electrons, in the form of a hollow cone, into the waveguide and a solenoid generates a magnetic field, extending axially along the waveguide, which causes the electrons in the beam to gyrate at the cyclotron frequency $\omega_c$. A solenoid coil, mounted on the side of the injection means remote from the solenoid, is used to modify the magnetic field prevailing in the vicinity of the hollow cone, to cause the field lines to extend along the electron beam.

7 Claims, 4 Drawing Figures

GYROTRON DEVICE

The present invention relates to a gyrotron device, for example a gyrotron amplifier or a gyrotron oscillator.

For a better understanding of the background to the invention, reference will now be made to FIGS. 1 and 2 of the accompanying drawing, in which.

Figure 1:
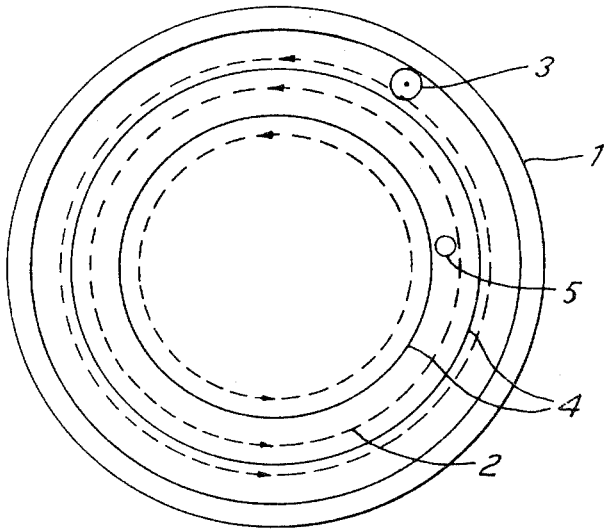
FIG. 1 is a section through a waveguide of a gyrotron device.

The manner of operation of a conventional gyrotron device is, in outline, as follows:

Referring to FIG. 1, a conventional gyrotron device comprises a circular waveguide 1 dimensioned to operate in the $TE_{01}$ mode at a chosen RF frequency. The $TE_{01}$ mode electric field is shown by dashed lines 2 in FIG. 1. An axial magnetic field 3 of strength B is applied to the waveguide and a hollow electron beam, the inner and outer bounds of which are indicated by thick lines 4, is passed along the waveguide.

Figure 2:
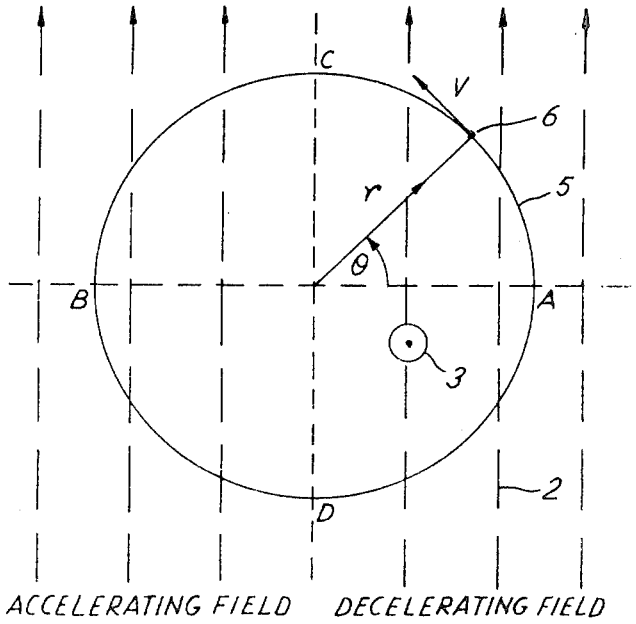
FIG. 2 illustrates an electron gyrating in an electric field and in a magnetic field.

As shown at 5 in FIGS. 1 and 2, an individual electron 6 is caused to gyrate under the influence of the magnetic field.

The electron gyrates at the so-called cyclotron frequency.

$$\omega_c = eB/m \qquad \text{(i)}$$

Where e is the electronic charge, B is the magnetic field strength, and m the relativistic mass of the electron. The radius of the orbit is given by $$r = mv/eB \qquad \text{(ii)}$$

where v is the tangential velocity of the electron.

The magnitude of the electric field is given by $$E = E_o \cos \omega_o t \qquad \text{(iii)}$$

where $\omega_o$ is the angular r.f. frequency.

At time $t=0$, the electric field is at a maximum given by $E=E_o$.

An electron at position A will experience a maximum retarding field, whereas an electron at position B will experience a maximum accelerating field. Half a cycle later, at time $=\pi/\omega_o$, the electric field will once again be at a maximum, but in the opposite direction, $$\text{i.e } E = -E_o.$$

If the angular frequency of the electron, $\omega_c$, is equal to the angular frequency of the applied r.f. field $\omega_o$, then the electron that started at A will now be at B, and once again experiencing a retarding field, whereas the electron that started at B will now be a A and once again experiencing and accelerating field.

In gyrotron devices, electrons in the beam have, at least when they are initially in the waveguide, many different phases relative to the RF field.

It can be seen that all electrons starting at time t=0 over the sector C A D, will experience a net decelerating field over a cycle. Therefore their velocity will decrease, as will their mass and hence, from equation (i) their frequency of rotation, $\omega_c$, will *increase*, so that they will advance in phase with respect to the applied r.f. electric field.

Electrons in this sector will therefore advance in phase, moving cycle by cycle, towards point C. Also from equation (ii), as the electron's mass and velocity decreases, so its radius of gyration will decrease.

Conversely, all electrons starting at time t=0 over the sector C B D will experience a net accelerating field. Their mass will increase and hence their frequency of rotation, $\omega_c$, will decrease, causing them to retard in phase with respect to the applied r.f. electric field. So electrons in this sector also will, cycle, by cycle, tend to move towards point C, with an ever increasing radius.

Hence there is cycle, by cycle, a bunching of all the electrons towards point C.

In gyrotron devices, the cyclotron frequency $\omega_c$ is slightly less than the angular RF frequency $\omega_o$, $$\text{e.g. } \omega_o = 1.029\omega_c$$

and the phase of the bunched electrons relative to the field is adjusted so that the electrons give up net energy to the RF field in excess of cavity losses so output power is available. The output power is dependent on the numbers of electrons bunched in the appropriate phase to give up energy to the RF field.

According to the present invention, there is provided a gyrotron device comprising, a waveguide, circular in cross-section, dimensioned to operate in a predetermined transverse electric mode and as an interaction region at a predetermined RF frequency, means for generating a magnetic field having field lines which, in part, extend parallel to the axis of the waveguide, and is of a strength to cause electrons to gyrate at a predetermined cyclotron frequency, and injection means for directing a beam of electrons into the waveguide, characterised in that, the injection means directs a beam of electrons, in the form of a hollow cone, into the waveguide so as to intersect the field lines, the electron beam having such a preset component of velocity perpendicular to the axis of the waveguide as to cause the electrons in the beam to gyrate in the magnetic field of said strength at the cyclotron frequency, and such a component of velocity parallel to the axis as to produce a plurality of cycles of the beam in the cavity, and that the device includes means for modifying the magnetic field prevailing in the vicinity of the hollow cone so that the field lines are constrained to extend along the said electron beam, having the form of a cone.

Figure 3:
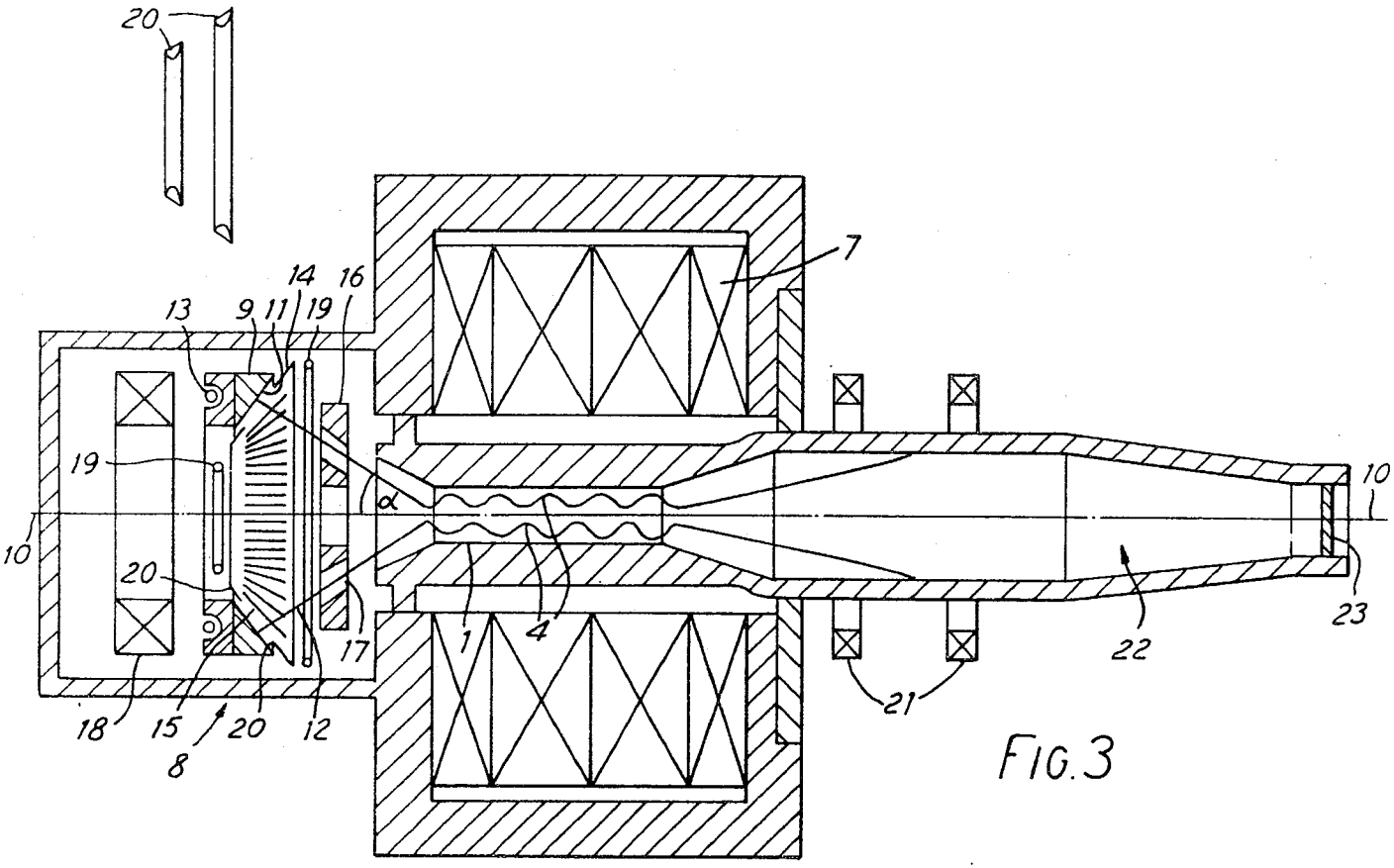
FIG. 3 illustrates a cross section through a gyrotron oscillator.

For a better understanding of the invention, illustrative embodiments of the invention will now be described in more detail with reference to the schematic FIGS. 3 and 4 which show a cross-section through a gyrotron oscillator and a gyrotron amplifier respectively. Referring to FIG. 3, which shows a gyrotron oscillator the circular waveguide 1, defines an interaction region which is dimensioned as a resonant cavity to operate in the fundamental $TE_{01}$ mode at the desired RF frequency $\omega_o$ whereby a standing wave is set up in the cavity. The axial magnetic field of strength B is produced by a solenoid 7 surrounding the waveguide.

The hollow electron beam 4 is produced by injection means 8.

The means 8 comprises an annular thermionic cathode, of triangular cross-section, coaxial with the axis 10 of the waveguide 1, the cathode 9 having a flat annular emissive surface 11 facing the axis 10, the normal 12 to the surface 11 having an angle of incidence $\alpha$ to the axis. An annular heater 13 is provided for the cathode 9.

A control grid 14 is annular and spaced from, and parallel to, the emissive surface 11 of the cathode, being in the form of a truncated hollow cone having many apertures 15 in it for the passage of electrons therethrough. An annular anode 16 having apertures 17 in it for the electrons is also provided.

The electrons in the beam are constrained to follow the normal 12 by producing a magnetic field directed parallel to the normal 12. This field is produced by modifying the lines of force of the magnetic field of the solenoid using some form of magnetic field modifier. In the example, an annular magnetic coil 18 on that side of the cathode 9 remote from the solenoid is used. The modification produces a magnetic field which is as nearly parallel to the normal 12 as possible with an abrupt transition to parallel to the axis 10. In order to modify the coherence of the beam an additional annular electrode is provided on the grid 14. This additional electrode may take the form of two annular wires 19 positioned at the respective sides of the grid 14. Each wire may be replaced by an annular electrode having a humped cross-section as shown at 20. The potentials applied to the cathode 9, the control grid 14, the additional electrode 19 or 20 and the anode 16 are chosen to produce a beam having a desired beam current and a desired beam velocity.

The beam velocity and angle $\alpha$ of incidence to the axis 10 is chosen so that: the component of velocity normal to the axis produces gyration of the electrons in the beam at the cyclotron frequency, $$\omega_c = eB/m,$$

required for interaction with the RF field of frequency $\omega_o$; and the component of velocity parallel to the axis is such that a plurality of complete cycles of the gyrating beam exist in the interaction region.

As described above, in the case of a gyrotron oscillator, the interaction region is dimensioned as a resonant cavity supporting an RF standing wave at the desired frequency $\omega_o$. The electron beam forms a standing wave in the cavity which in turn generates an RF standing wave, at the frequency $\omega_o$.

As the electron beam passes along the waveguide 1 it progressively interacts with, and gives up energy to, the RF field. The beam in finally diverged by magnetic coils 21 into the collector region in the output waveguide 22 which is sealed by a window 23.

Figure 4:
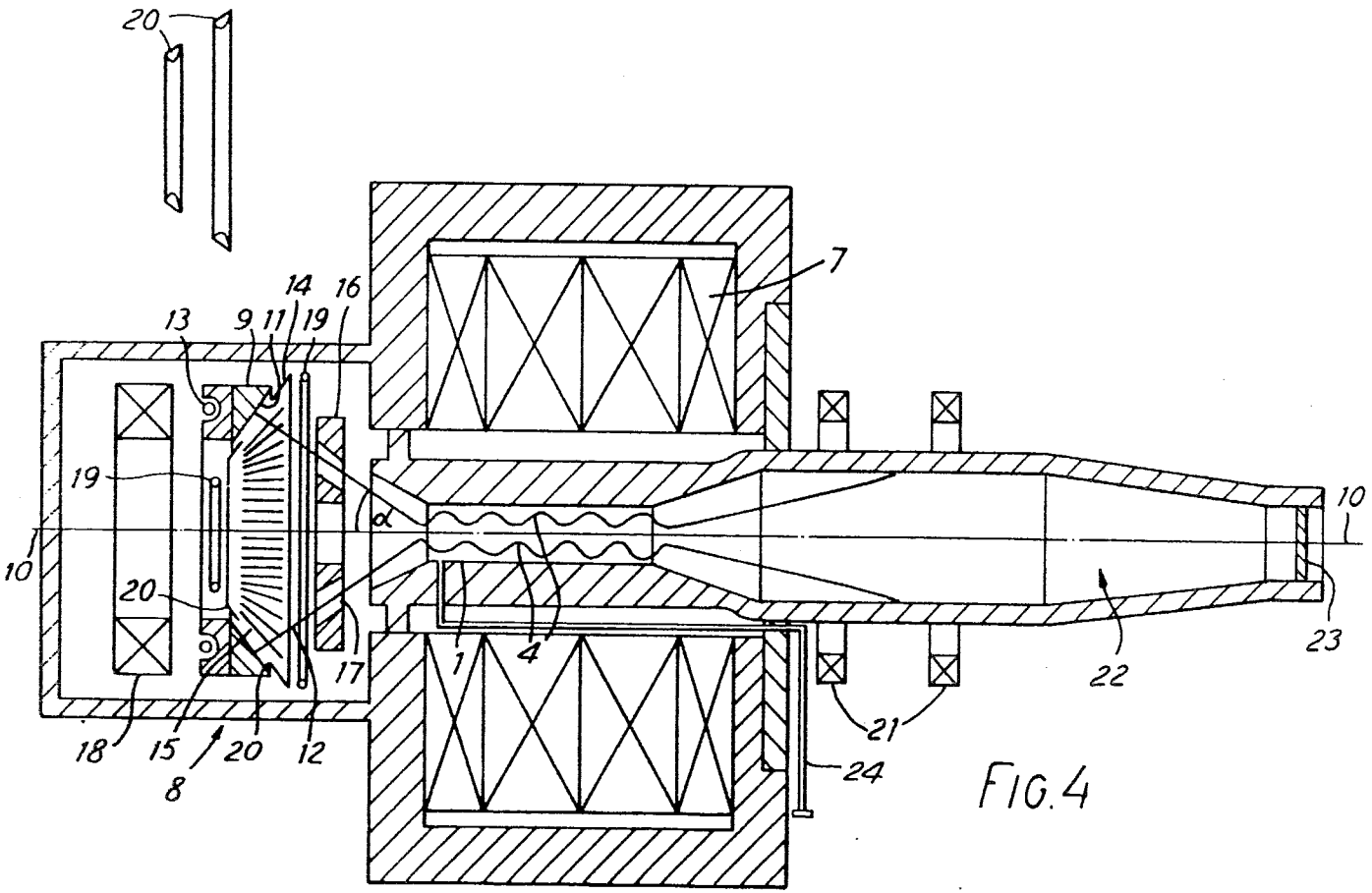
FIG. 4 illustrates a cross section through a gyrotron amplifier.

In the case of a gyrotron amplifier the interaction region is dimensioned so as not to resonate at the frequency $\omega_o$ and, as shown in FIG. 4, a waveguide feed 24 is provided to introduce RF energy, of frequency $\omega_o$, into the cavity. In other respects, however, the amplifier and oscillator are identical.

Although the invention has been described in relation to a $TE_{01}$ mode RF field, other transverse electric modes e.g. $TE_{02}$, $TE_{11}$ could be used.

What we claim is:

1. A gyrotron device comprising, a waveguide, circular in cross-section, which is dimensioned to accommodate a predetermined transverse electric mode and to operate as an interaction region at a predetermined radio frequency, means for generating a magnetic field having field lines which, in said interaction region, are parallel to the axis of the waveguide and is of a strength sufficient to cause electrons, introduced into the interaction region, to gyrate at a predetermined cyclotron frequency ($\omega_c$), injection means for introducing electrons into said interaction region, the injection means comprising a thermionic cathode for producing a beam of electrons in the form of a hollow cone which is centred on said axis and intersects said parallel field lines at a preset angle, and wherein each electron follows a linear trajectory from said cathode to the interaction region said angle being chosen to establish a preset component of velocity for said beam perpendicular to the axis of the waveguide, sufficient to cause electrons in the beam to gyrate as a result of their interaction with the parallel field lines at the cyclotron frequency and a preset component of velocity parallel to the axis of the waveguide sufficient to produce a plurality of cycles of the beam in the waveguide, and means for modifying the magnetic field prevailing in the vicinity of the hollow cone to constrain the field lines to run substantially parallel to the electron beam in the form of said hollow cone.

2. A gyrotron device according to claim 1 wherein the means for modifying the magnetic field comprises coil means mounted on that side of the injection means remote from said magnetic field generation means.

3. A gyrotron device according to claim 1 or claim 2 wherein the thermionic cathode has an annular emmisive surface which is centred on a said axis, the normal to said surface being inclined at an acute angle ($\alpha$) to the axis.

4. A gyrotron device according to claim 3 wherein the cathode includes a heater in the form of an annular wire.

5. A gyrotron device according to claim 1 or claim 2 including means for introducing RF energy, of said predetermined frequency, into the interaction region.

6. A gyrotron device according to claim 1 or claim 2 in the form of a gyrotron oscillator wherein the interaction region is dimensioned as a resonant cavity at the predetermined RF frequency.

7. A gyrotron device according to claim 1 or claim 2 wherein the wave guide is dimensioned to operate in the $TE_{01}$ mode.

* * * * *